US008607890B2

(12) United States Patent
Liebl et al.

(10) Patent No.: US 8,607,890 B2
(45) Date of Patent: Dec. 17, 2013

(54) FLOATING PIVOT JOINT FOR WORK IMPLEMENT

(75) Inventors: John G. Liebl, Atwater, MN (US); Jesse A. Knudsen, Litchfield, MN (US)

(73) Assignee: Clark Equipment Company, West Fargo, ND (US)

( * ) Notice: Subject to any disclaimer, the term of this patent is extended or adjusted under 35 U.S.C. 154(b) by 438 days.

(21) Appl. No.: 12/562,526

(22) Filed: Sep. 18, 2009

(65) Prior Publication Data

US 2011/0067893 A1 Mar. 24, 2011

(51) Int. Cl.
*E02F 3/76* (2006.01)

(52) U.S. Cl.
USPC ..... 172/821

(58) Field of Classification Search
USPC ..... 172/820, 821
See application file for complete search history.

(56) References Cited

U.S. PATENT DOCUMENTS

| | | | | |
|---|---|---|---|---|
| 1,730,817 | A | 10/1929 | Gyllenkrook | |
| 3,150,884 | A | 9/1964 | Drott | |
| 3,365,822 | A | 1/1968 | Howie | |
| 3,477,151 | A | 11/1969 | Zanella | |
| 3,893,519 | A | 7/1975 | Deli et al. | |
| 3,913,684 | A | 10/1975 | Casey et al. | |
| 3,933,207 | A | 1/1976 | Frisbee | |
| 4,019,587 | A | 4/1977 | Meisel, Jr. | |
| 4,081,036 | A * | 3/1978 | Yokoyama | 172/821 |
| 4,270,617 | A * | 6/1981 | Cantarella et al. | 172/821 |
| 4,562,891 | A | 1/1986 | Ranner | |
| 4,828,044 | A | 5/1989 | Horsch et al. | |
| 4,828,045 | A * | 5/1989 | Horsch et al. | 172/821 |
| 4,893,683 | A | 1/1990 | Horsch et al. | |
| 4,919,212 | A * | 4/1990 | McClure | 172/274 |
| 4,986,010 | A * | 1/1991 | Cartner | 37/382 |
| 5,010,961 | A * | 4/1991 | Frisbee | 172/821 |
| 5,025,577 | A | 6/1991 | Verseef | |
| 5,058,685 | A * | 10/1991 | Moffitt | 172/820 |
| 5,082,065 | A * | 1/1992 | Fletcher | 172/273 |
| 5,267,618 | A | 12/1993 | Harrell | |
| 5,400,859 | A | 3/1995 | Harrell | |
| 5,560,129 | A | 10/1996 | Rothbart | |
| 6,109,363 | A * | 8/2000 | High | 172/820 |
| 6,412,200 | B1 | 7/2002 | Savard | |
| 6,719,066 | B2 * | 4/2004 | Haringer | 172/821 |
| 6,863,461 | B2 * | 3/2005 | Werner | 403/43 |

OTHER PUBLICATIONS

On-line brochure Snow Wolf Professional Snow Plow System and Accessories, accessed and printed in 2009, 12 pages.

* cited by examiner

*Primary Examiner* — Thomas B Will
*Assistant Examiner* — Joel F. Mitchell
(74) *Attorney, Agent, or Firm* — John D. Veldhuis-Kroeze; Westman, Champlin & Koehler, P.A.

(57) ABSTRACT

An implement capable of being attached to a power machine having a mounting portion and a tool portion. The mounting portion is configured to engage with, and be secured to, an implement carrier on the power machine. The tool portion is capable of performing a work function. The implement has a joint for attaching the tool portion to the mounting portion and an actuator having first and second ends with the first end attached to the mounting portion at a first actuator attachment point and second end attached to the tool portion at a second actuator attachment point. The tool portion is capable of rotating about an axis that extends through the joint. The joint is capable of pivoting so that the axis about which the tool portion rotates is rotatable with respect to the tool portion.

20 Claims, 6 Drawing Sheets

FLOATING PIVOT JOINT FOR WORK IMPLEMENT

BACKGROUND

The present discussion is related to work implements that are capable of being attached to a power machine such as a wheeled loader having an engine-powered drive system. The present discussion is more particularly related to pivot joints on work implements for allowing one portion of the work implement to pivot with respect to another portion of the work implement.

Power machines such as skid steer loaders, tracked vehicles, mini-excavators, utility vehicles, front and/or rear wheel steer loaders and the like have high utility in construction, landscaping, agriculture, and many other types of applications. One aspect of that utility is ability of certain power machines to be attached to and control a variety of different work implements. One example of a work implement is a blade that can be used to push material such as snow. Such blades can be manipulated to change the angle of the blade with respect to the power machine.

SUMMARY

In one illustrative embodiment, an implement capable of being attached to a power machine is disclosed. The implement includes a mounting portion that is configured to engage with, and be secured to, an implement carrier on the power machine. The implement also includes a tool portion capable of performing a work function. A joint attaches the tool portion to the mounting portion. The implement also includes an actuator with a first end attached to the mounting portion and a second end attached to the tool portion. The tool portion is capable of rotating about an axis that extends through the joint. The joint is capable of pivoting so that the axis about which the tool portion rotates is rotatable with respect to the mounting portion.

While the above-identified figures set forth one or more illustrative embodiments, other embodiments are also contemplated, as noted herein. In all cases, concepts presented herein describe the embodiments by way of representation and not by limitation. It should be understood that numerous other modifications and embodiments can be devised by those skilled in the art which fall within the scope and spirit of the principles of the discussion herein.

DETAILED DESCRIPTION

Figure 1:
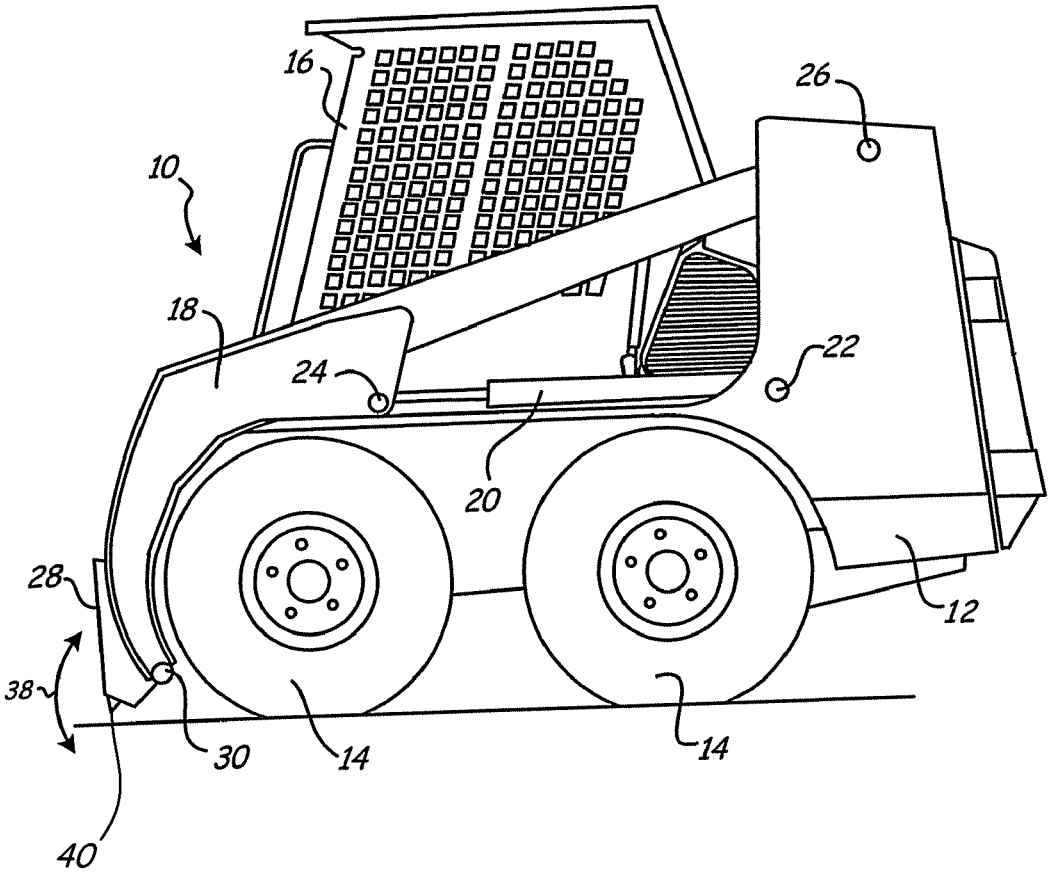
FIG. 1 is a side elevation view of a power machine of the type to which a work implement such as those discussed herein might be advantageously coupled.

FIG. 1 illustrates a power machine 10 of the type capable of being coupled with, and controlling, a work attachment such as those discussed in the embodiments below. Power machine 10 includes a frame 12 that is supported by wheels 14. Power machine 10 has an engine (not shown in FIG. 1) that applies power to a drive system (not shown in FIG. 1), which in turn supplies power to the wheels 14 causing power machine 10 to move under the control of an operator. Examples of drive systems for use in power machine 10 will be discussed in more detail below. Frame 12 supports a cab 16, which defines an operating compartment.

Power machine 10, as illustrated in FIG. 1, further includes a lift arm 18. Lift arm 18 is coupled to frame 12 at pivot point 26. Actuator 20 is coupled to the frame 12 at first pivot point 22 and the lift arm at second pivot point 24. Actuator 20, of the power machine 10 shown in FIG. 1 is a hydraulic cylinder, although other suitable types of actuators may be used. A single lift arm 18 is shown in FIG. 1, but it is to be understood that a similar lift arm 18 and corresponding actuator 20 may be positioned on the opposite side of the cab and similarly attached to frame 12. Further, it should be understood that such a lift arm may be coupled to the lift arm 18 shown in FIG. 1 via a cross-member (not shown) extending between and attached to each of the lift arms 18.

Power machine 10 further includes an implement carrier 28, which is rotatably coupled to the lift arm 18 about attachment point 30. One or more tilt actuators (not shown) are coupled to the implement carrier 28 and the one or more lift arms 18 (or the cross-member therebetween). Actuation of the one or more tilt actuators causes the implement carrier 28 to rotate about the attachment point 30 in a direction shown by arrow 38. Implement carrier 28 is configured to engage and be attached to a variety of different work implements. The implement carrier 28 is shown with an engagement pin 40, which is capable of engaging a work implement to secure the work implement to the power machine 10. While only one engagement pin 40 is shown in FIG. 1, it should be understood that a second engagement pin can be positioned inline with the engagement pin 40 illustrated in FIG. 1. The engagement pin 40 is shown in an extended position, but it should be understood that it is capable of being retracted to allow a work implement to be attached to and/or removed from the power machine 10. The power machine 10 also includes an auxiliary power source (not shown), which is available for utilization by a work implement. The auxiliary power source is illustratively controlled by a user to provide a power source to operate function devices such as an actuator on a work implement that is operably coupled to power machine 10. The auxiliary power source provided by some power machines is a hydraulic power source to which a work implement is coupled.

An operator can be located inside the cab 16 and control the power machine 10 by manipulating control devices (not shown in FIG. 1) located therein to send operator control signals to control functions of the power machine 10. For example, an operator can manipulate control devices to send operator signals to control the direction and rate of ground travel of the power machine. In addition, manipulating control devices can cause the power machine to raise or lower the lift arm 18 or cause the implement carrier 28 to rotate about the attachment point 30 as well as control functional devices on a work implement. When an implement is coupled to the implement carrier 28, manipulation of the lift arm 18 or rotating the implement carrier 28 affects the position of the work implement with respect to the power machine 10.

Figure 2:
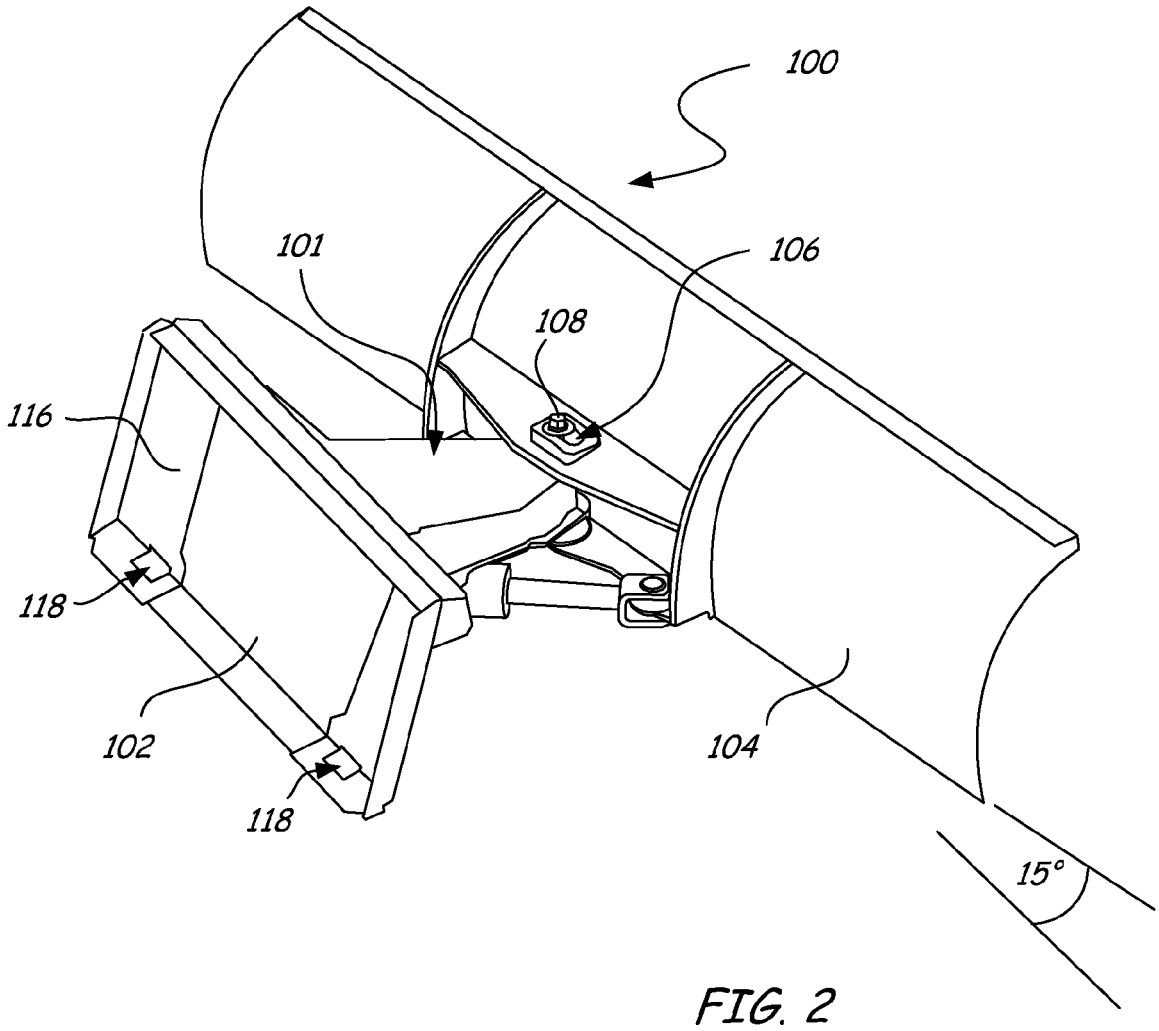
FIG. 2 is a perspective view of an implement having a pivotable blade that is capable of being coupled to the power machine illustrated in FIG. 1 according to one illustrative embodiment.

FIG. 2 illustrates an implement 100 that is configured to be attached to a power machine such as power machine 10 according to one illustrative embodiment. Implement 100 is a snow blade suitable for pushing snow or other material off of a surface, although other implements may include the features highlighted in the present discussion. The implement 100 includes a mounting portion 102, which is capable of being coupled to the implement carrier 28 of power machine 10. The implement 100 also includes a blade 104, which is rotatably coupled to the mounting portion 102 at pivot joint 106 with a pin 108. A pivot actuator 110 is coupled to the mounting portion 102 and the blade 104. In one embodiment, the actuator 110 is a hydraulic cylinder, which receives hydraulic fluid from the auxiliary power source when the implement 100 is coupled to the power machine 10. Actuation of the actuator 110 to either extend or retract the cylinder causes the blade 104 to be rotated about the pivot joint 106. In FIG. 2, the blade 104 is shown as being rotated about 15 degrees. For the purposes of this discussion, the implement 100 has a top surface 101 and a bottom surface, which opposes the top surface 101. It should be understood that the use of the term "top surface" in the context of this discussion refers to not only the top surface of the implement 100, but also to a top surface of components of the implement 100 such as the mounting portion 102 and the blade 104.

Figure 3:
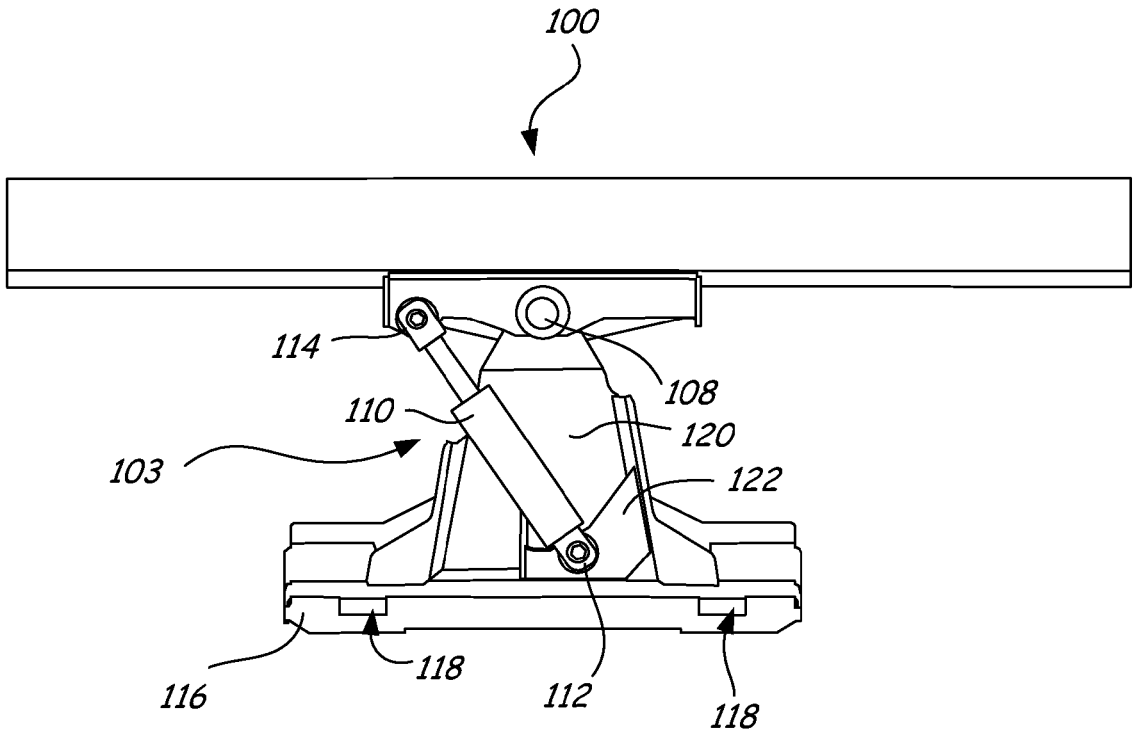
FIG. 3 is a bottom view of the implement of FIG. 2, illustrating a joint on the implement that pivotally couples a blade to a mounting structure.

FIG. 3 illustrates a bottom surface 103 of the implement 100 shown in FIG. 2. The actuator 110 is shown as being coupled to the mounting portion 102 at first mounting location 112 and to the blade 104 at a second mounting location 114. At each of the first and second mounting locations 112 and 114, the actuator 110 is illustratively coupled to ball joints, which allow the actuator 110 freedom of movement with respect to the mounting portion 102 and the blade 104. The ball joints are illustratively ball and socket arrangements where the ball is allowed to rotate within the socket. The balls may be captured within the socket. Pins extend through the balls so that when the actuator is coupled at the first and second mounting locations 112 and 114, the actuator is secured to the ball located at each mounting location and is thereby allowed to move with each ball. More particularly, the ball joints allow the actuator freedom of movement to keep the actuator aligned in the event that the blade 104 should pivot with respect to the mounting portion 102.

The mounting portion 102 includes a machine interface 116, which is configured to be attached to the implement carrier 28 of power machine 10 to couple the implement 100 to the power machine 10. The machine interface 116 includes a pair of apertures 118, which are positioned to accept the engagement pins 40 when the mounting portion 102 is attached to the implement carrier 28. The mounting portion 102 also includes a support structure 120, which is attached to, and extends generally perpendicularly from, the machine interface 116. The support structure 120 includes a mounting bracket 122 for a base end of the actuator 110.

Figure 5:
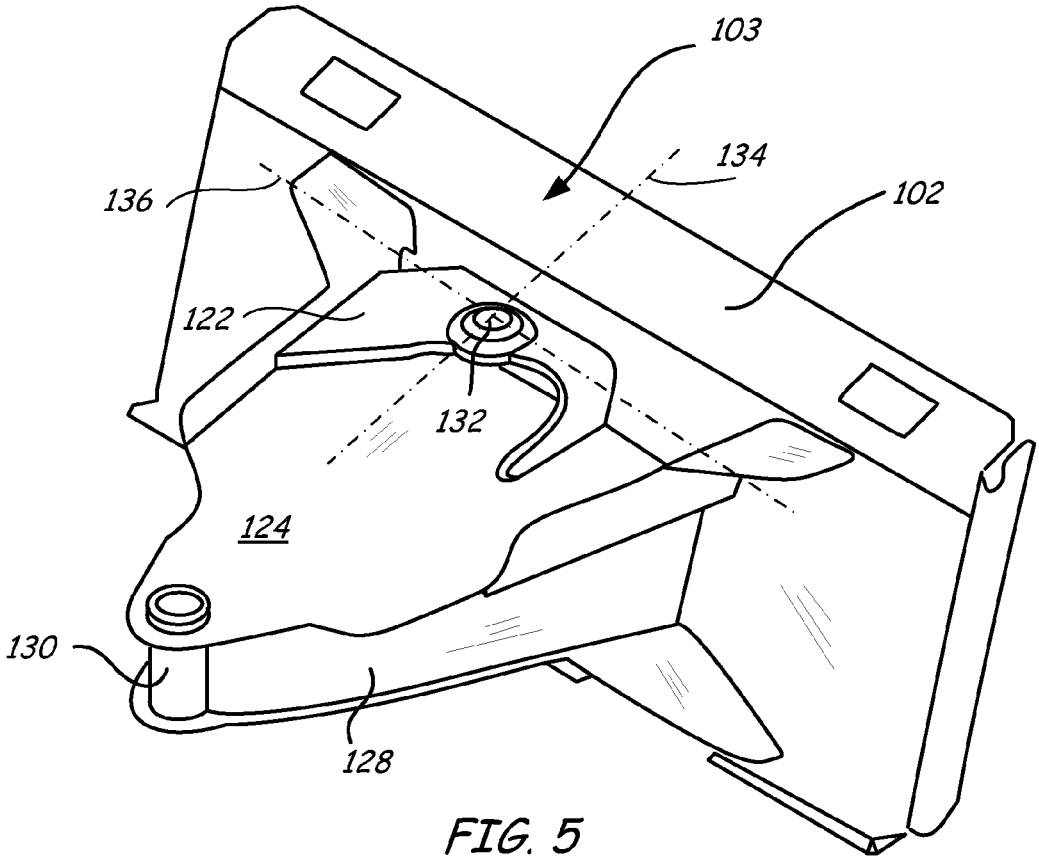
FIG. 5 is a perspective view of the mounting structure shown in FIG. 4, illustrating a bottom surface of the mounting structure.
Figure 4:
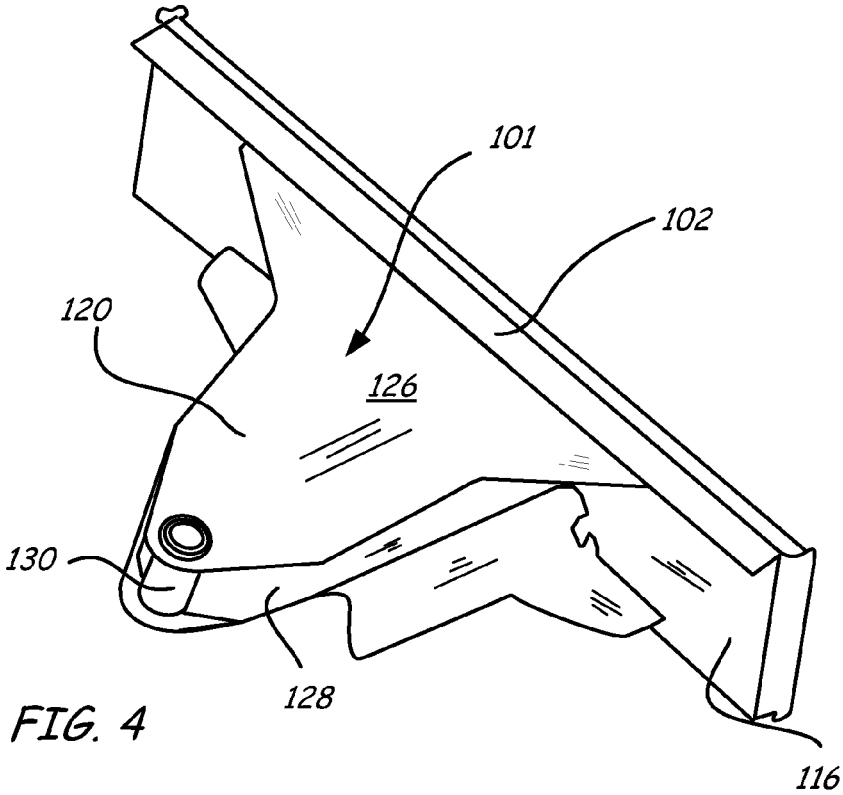
FIG. 4 is a perspective view of the mounting structure shown in FIG. 3, illustrating a top surface of the mounting structure.

FIGS. 4 and 5 show the mounting portion 102 of implement 100 from different perspectives. In FIG. 4, the mounting portion 102 is shown from a perspective view that generally shows the top surface 101 of the mounting portion 102, whereas in FIG. 5, the mounting structure is shown from a perspective that generally shows the bottom surface 103. The support structure 120 includes generally flat first and second plates 124 and 126 that extend from the machine interface 116. The first and second plates 124 and 126 are spaced apart by and attached to spacers 128. The first and second plates 124 and 126 are folded near the machine interface 116, which provides added strength to the mounting structure. A hollow tube 130 extends between the first and second plates 124 and 126. Each of the first and second plates 124 and 126 have an aperture formed into them to allow a path through the tube 130 from the top surface 101 to the bottom surface 103. The inner diameter of the tube 130 is such that pin 108 can extend through the tube 130. Mounting bracket 122 is shown in FIG. 5. Mounting bracket 122 includes a ball joint 132 to which actuator 110 is to be attached. The ball joint 132 allows the actuator 110 to move about axes 134 and 136 with respect to the mounting bracket 122.

Figure 6:
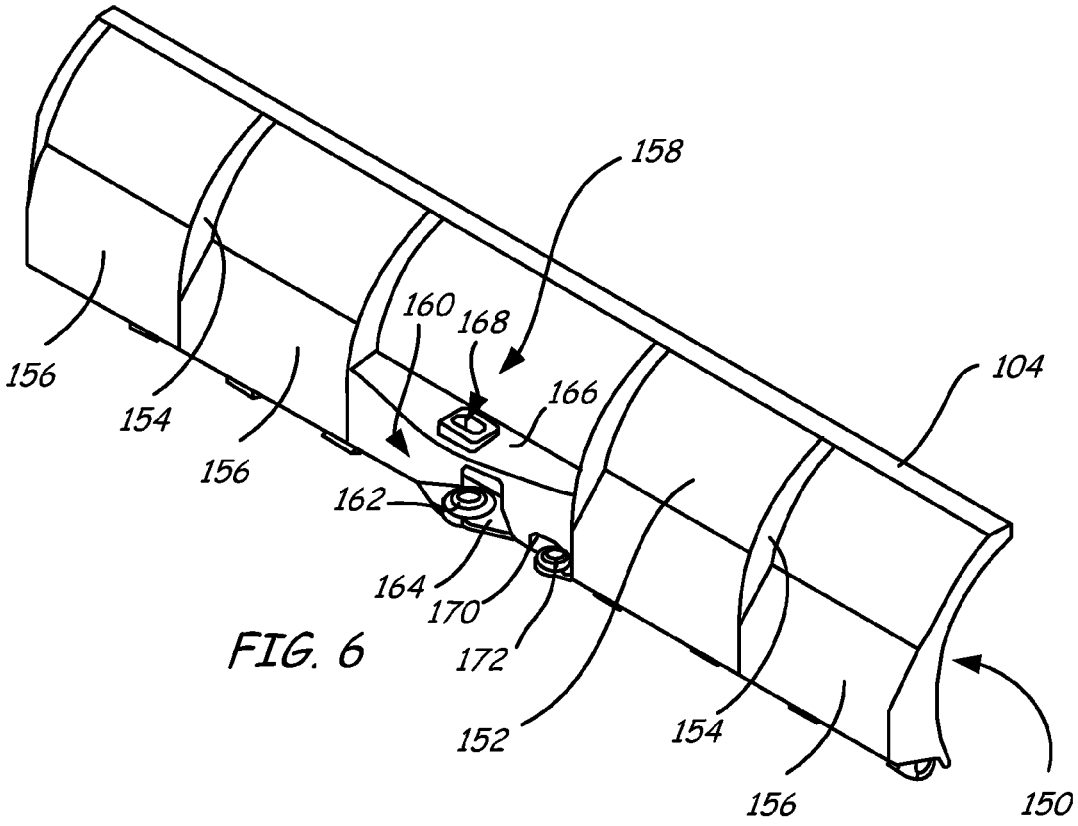
FIG. 6 is a perspective view of the blade illustrated in FIG. 3, showing a rear portion of the blade.
Figure 7:
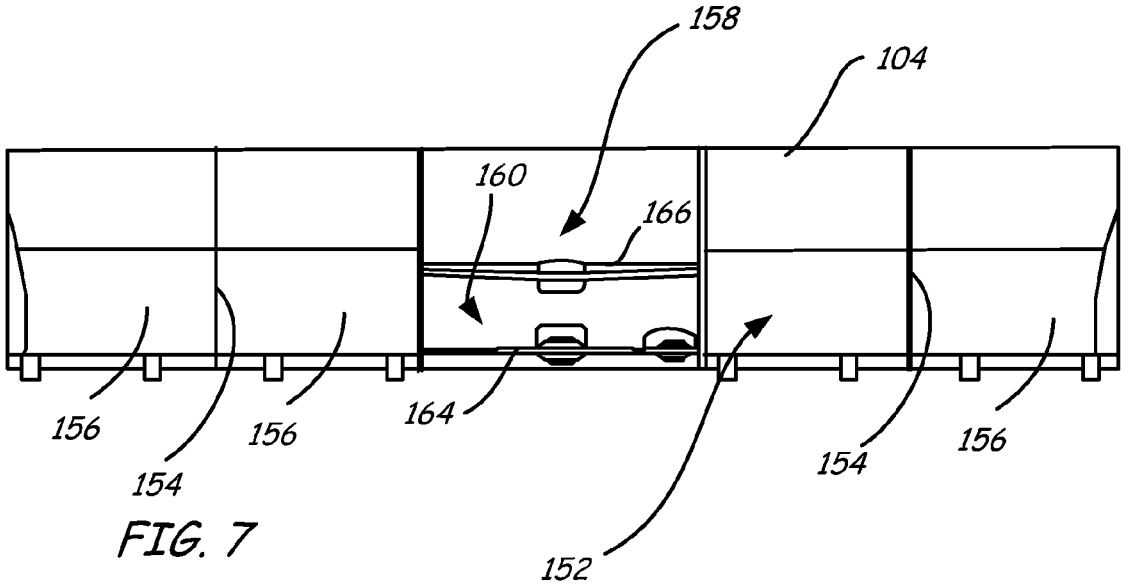
FIG. 7 is a rear elevation view of the blade illustrated in FIG. 3.

FIGS. 6 and 7 illustrate the blade 104. Blade 104 has a first side 150, which is generally curved and configured to engage material such as snow and push it when a power machine is used in conjunction with the implement 100. Blade 104 has a second side 152, which opposes the first side 150. The second side 152 of the blade 104 has a plurality of ribs 154 attached to it, which provide reinforcement for the blade 104. A series of plates 156 are attached to and positioned between the ribs 154 as well as being attached to the second side 152 of the blade 104 to provide additional structural rigidity. In some embodiments, such as is shown in FIGS. 2 and 3, some or all of the ribs 154 and plates 156 may be omitted. In addition, attached to a central portion 158 of the second side 152 of the blade 104 is an engagement structure 160 for attaching the blade 104 to the mounting structure illustrated in FIGS. 4 and 5. The engagement structure 160 includes a ball joint 162 captured in a bracket 164 and a bracket 166 with a slotted aperture 168 extending through it. The brackets 164 and 166 are spaced apart to allow the tube 130 that is attached to the machine interface 116 to be positioned between the brackets 164 and 166. Pin 108 is then fit through the ball joint 162, the tube 130, and the slotted aperture 168.

The slotted aperture 168 allows the pin 108 to rotate about the ball joint 162. By allowing the pin 108 to rotate about the ball joint 162, the blade 104 is allowed to pivot from side to side with respect to mounting portion 102. This allows the blade 104 to conform to irregular terrain. In one embodiment, the slotted aperture 168 restricts the rotation of the pin 108 about the ball joint 162 to a single axis. The slotted aperture 168 further restricts the rotation of the pin 108 about the ball joint 162 along the single axis. Returning briefly to FIG. 2, the pin 108 is shown rotated so that it engages an edge of the slotted aperture 168 in one direction. On a flat, even surface, the pin 108 would be in positioned in the center of the slotted aperture 108. In one embodiment, the pin 108 is allowed to pivot five degrees in each direction from the center position, for a total of ten degrees of allowed rotation. In other embodiments, the slotted aperture 168 can be sized to allow for more or less rotation than the five degrees in either direction from a center position as is illustrated in FIG. 2. Bracket 170 includes a ball joint 172, which provides an attachment point (the second mounting location 114, as illustrated in FIG. 3) for the actuator 110.

The embodiments discussed above provide important advantages. By having a work implement that can pivot from side to side, the work implement can engage a support surface that may have an irregular topology. By providing for a pivot joint generally in the center of the work portion of the implement, the work portion of the implement can pivot in either direction easily and uniformly. In addition, by employing a ball and socket arrangement to accomplish oscillation of the blade, minimal lateral movement of the blade occurs, which provides a smoother operation and better control of the blade. Further, the actuator used to adjust the angle of the work portion of the implement is mounted to allow it to adjust to situations where the work tool is pivoted on uneven terrain so that forces from the actuator do not cause or prevent the pin to pivot. Although specific embodiments are disclosed above, it should be understood that the embodiments are illustrative in nature. Other embodiments that are within the spirit and similar to those presented here will be apparent to those skilled in the art.

What is claimed is:

1. An implement capable of being attached to a power machine having a moveable lift arm powered by an actuator and an implement carrier pivotally attached to an end of the lift arm, comprising:

a mounting portion configured to engage with, and be releasably secured to, the implement carrier;

a tool portion capable of performing a work function;

a joint for attaching the tool portion to the mounting portion;

an actuator configured to pivot the tool portion about an axis that extends through the joint and having first and second ends with the first end attached to a first actuator attachment ball joint at a first actuator attachment point on the mounting portion and the second end attached to a ball joint at a second actuator attachment point on the tool portion; and wherein the joint is configured to pivot so that the axis about which the tool portion rotates is rotatable with respect to the tool portion and wherein the actuator is configured to pivot with respect to the first and second actuator attachment ball joints to allow for adjustment of first and second attachment points as the joint pivots.

2. The implement of claim 1, wherein mounting portion includes first and second spaced apart plates and a first attachment feature extending between the first and second spaced apart plates, and wherein the tool portion includes a second attachment feature and wherein the first and second attachment features form a portion of the joint.

3. The implement of claim 2, wherein the first attachment feature includes a tube extending between the first and second plates, wherein the second attachment feature includes a first structure having a ball and socket arrangement, wherein the ball of the first structure has an aperture extending therethrough, and wherein the joint further comprises:

a pin extending through the ball of the first structure and the tube of the first attachment feature to rotatably secure the tool portion to the mounting portion.

4. The implement of claim 3, wherein the second attachment feature further includes a bracket with a slotted aperture, wherein the pin extends through the slotted aperture when the tool portion is rotatably secured to the mounting portion.

5. The implement of claim 4, wherein the pin engages the bracket within the slotted aperture to restrict pivoting of the joint to a single axis of rotation.

6. The implement of claim 5, wherein the pin engages the bracket within the slotted aperture to restrict pivoting of the joint to about ten degrees of rotation.

7. The implement of claim 4, wherein the tool portion is capable of floating with respect to the mounting portion limited only by engagement of the pin with the slotted aperture.

8. The implement of claim 1, wherein the first end of the actuator is secured to the mounting portion with a pin.

9. The implement of claim 1, wherein the second end of the actuator is secured to the tool portion with a pin.

10. The implement of claim 1, wherein the work tool is a blade capable of engaging material to push the material.

11. The implement of claim 1, wherein the mounting portion includes:

a machine interface having a generally flat surface extending horizontally and configured to engage with, and be rigidly secured to, the implement carrier on the power machine;

a support structure rigidly mounted to and extending distally from the machine interface; and wherein the tool portion is attached to the support structure.

12. The implement of claim 1, wherein the tool portion is otherwise unattached to the mounting portion.

13. An implement capable of being attached to a power machine having a moveable lift arm powered by an actuator and an implement carrier pivotally attached to an end of the lift arm, comprising:

a mounting portion configured to engage with, and be releasably secured to the implement carrier on the power machine, the mounting portion including:

a machine interface having a generally flat surface extending horizontally and configured to engage with, and be rigidly secured to, the implement carrier on the power machine; and a support structure rigidly mounted to and extending distally from the machine interface and having first and second spaced apart plates and a first attachment feature comprising a tube extending between the first and second plates;

a tool portion capable of performing a work function, the tool portion including a second attachment feature comprising a first structure having a ball and socket arrangement, the ball of the first structure having an aperture extending therethrough, the second attachment feature further including a bracket with a slotted aperture spaced apart from the ball and socket arrangement of the first structure;

a joint for attaching the tool portion to the support structure, wherein the joint comprises the tube of the first attachment feature, the first structure ball and socket arrangement and the bracket with the slotted aperture of the second attachment feature, and a first pin extending through the ball, the tube and the slotted aperture to rotatably secure the tool portion to the mounting portion;

an actuator having first and second ends with the first end attached to the mounting portion at a first actuator attachment point and second end attached to the tool portion at a second actuator attachment point wherein each of the first actuator attachment point and the second actuator attachment point includes a ball joint; and wherein the tool portion is capable of rotating about an axis that extends through the joint under power from the actuator and wherein the joint is capable of pivoting on uneven terrain so that the axis about which the tool portion rotates is rotatable with respect to the tool portion.

14. The implement of claim 13, wherein the first pin engages the bracket within the slotted aperture to restrict pivoting of the joint to a single axis of rotation.

15. The implement of claim 14, wherein the first pin engages the bracket within the slotted aperture to restrict pivoting of the joint to about ten degrees of rotation.

16. The implement of claim 13, wherein the first end of the actuator is secured to the mounting portion with a second pin.

17. The implement of claim 16, wherein the second end of the actuator is secured to the tool portion with a third pin.

18. The implement of claim 13, wherein the work tool is a blade capable of engaging material to push the material.

19. The implement of claim 13, wherein the tool portion is otherwise unattached to the mounting portion.

20. The implement of claim 13, wherein the tool portion is capable of floating with respect to the support structure limited only by engagement of the first pin with the slotted aperture.

* * * * *